US006884156B2

(12) United States Patent
Prasad et al.

(10) Patent No.: US 6,884,156 B2
(45) Date of Patent: Apr. 26, 2005

(54) MULTI-LAYER POLISHING PAD MATERIAL FOR CMP

(75) Inventors: Abaneshwar Prasad, Naperville, IL (US); Roland K. Sevilla, Aurora, IL (US); Michael S. Lacy, Naperville, IL (US)

(73) Assignee: Cabot Microelectronics Corporation, Aurora, IL (US)

( * ) Notice: Subject to any disclaimer, the term of this patent is extended or adjusted under 35 U.S.C. 154(b) by 0 days.

(21) Appl. No.: 10/463,680

(22) Filed: Jun. 17, 2003

(65) Prior Publication Data

US 2004/0259484 A1 Dec. 23, 2004

(51) Int. Cl.[7] ..... B24D 11/00
(52) U.S. Cl. ..... 451/533; 451/530; 451/527
(58) Field of Search ..... 451/41, 527, 528, 451/530, 533, 537, 538

(56) References Cited

U.S. PATENT DOCUMENTS

| | | | | |
|---|---|---|---|---|
| 3,504,457 | A | 4/1970 | Jacobsen | |
| 3,581,439 | A | 6/1971 | Jensen, Jr. | |
| 5,257,478 | A | 11/1993 | Hyde et al. | |
| 5,605,760 | A | 2/1997 | Roberts | |
| 5,893,796 | A | 4/1999 | Birang et al. | |
| 6,007,407 | A | 12/1999 | Rutherford et al. | |
| 6,089,963 | A | 7/2000 | Wiand et al. | |
| 6,171,181 | B1 | 1/2001 | Roberts et al. | |
| 6,328,642 | B1 * | 12/2001 | Pant et al. | 451/307 |
| 6,358,130 | B1 * | 3/2002 | Freeman et al. | 451/285 |
| 6,425,816 | B1 | 7/2002 | Roberts et al. | |
| 6,524,164 | B1 * | 2/2003 | Tolles | 451/6 |
| 6,524,176 | B1 * | 2/2003 | Cheng et al. | 451/526 |
| 2002/0111120 | A1 | 8/2002 | Goetz | |
| 2002/0115385 | A1 * | 8/2002 | Misra et al. | 451/41 |
| 2003/0129931 | A1 * | 7/2003 | Konno et al. | 451/285 |

* cited by examiner

*Primary Examiner*—Dung Van Nguyen

(57) ABSTRACT

The invention is directed to a multi-layer polishing pad for chemical-mechanical polishing comprising a polishing layer and a bottom layer, wherein the polishing layer and bottom layer are joined together without the use of an adhesive. The invention is also directed to a polishing pad comprising an optically transmissive multi-layer polishing pad material, wherein the layers of the polishing pad material are joined together without the use of an adhesive.

38 Claims, 4 Drawing Sheets

MULTI-LAYER POLISHING PAD MATERIAL FOR CMP

FIELD OF THE INVENTION

This invention pertains to an adhesive-free multi-layer polishing pad material for use in chemical-mechanical polishing.

BACKGROUND OF THE INVENTION

Chemical-mechanical polishing ("CMP") processes are used in the manufacturing of microelectronic devices to form flat surfaces on semiconductor wafers, field emission displays, and many other microelectronic substrates. For example, the manufacture of semiconductor devices generally involves the formation of various process layers, selective removal or patterning of portions of those layers, and deposition of yet additional process layers above the surface of a semiconducting substrate to form a semiconductor wafer. The process layers can include, by way of example, insulation layers, gate oxide layers, conductive layers, and layers of metal or glass, etc. It is generally desirable in certain steps of the wafer process that the uppermost surface of the process layers be planar, i.e., flat, for the deposition of subsequent layers. CMP is used to planarize process layers wherein a deposited material, such as a conductive or insulating material, is polished to planarize the wafer for subsequent process steps.

In a typical CMP process, a wafer is mounted upside down on a carrier in a CMP tool. A force pushes the carrier and the wafer downward toward a polishing pad. The carrier and the wafer are rotated above the rotating polishing pad on the CMP tool's polishing table. A polishing composition (also referred to as a polishing slurry) generally is introduced between the rotating wafer and the rotating polishing pad during the polishing process. The polishing composition typically contains a chemical that interacts with or dissolves portions of the uppermost wafer layer(s) and an abrasive material that physically removes portions of the layer(s). The wafer and the polishing pad can be rotated in the same direction or in opposite directions, whichever is desirable for the particular polishing process being carried out. The carrier also can oscillate across the polishing pad on the polishing table. CMP polishing pads often comprise two or more layers, for example a polishing layer and a bottom (e.g., subpad) layer, which are joined together through the use of an adhesive, such as a hot-melt adhesive or a pressure-sensitive adhesive. Such a multi-layer polishing pad is disclosed, for example, in U.S. Pat. No. 5,257,478.

In polishing the surface of a workpiece, it is often advantageous to monitor the polishing process in situ. One method of monitoring the polishing process in situ involves the use of a polishing pad having a "window" that provides a portal through which light can pass to allow the inspection of the workpiece surface during the polishing process. Such polishing pads having windows are known in the art and have been used to polish workpieces, such as semiconductor devices. For example, U.S. Pat. No. 5,893,796 discloses removing a portion of a polishing pad to provide an aperture and placing a transparent polyurethane or quartz plug in the aperture to provide a transparent window. Similarly, U.S. Pat. No. 5,605,760 provides a polishing pad having a transparent window formed from a solid, uniform polymer material that is cast as a rod or plug. The transparent plug or window typically is integrally bonded to the polishing pad during formation of the polishing pad (e.g., during molding of the pad) or is affixed in the aperture of the polishing pad through the use of an adhesive.

Prior art polishing pads that rely on adhesives to join together polishing pad layers or to affix windows within the polishing pad have many disadvantages. For example, the adhesives often have harsh fumes associated with them and typically require curing over 24 hours or more. Moreover, the adhesive can be susceptible to chemical attack from the components of the polishing composition, and so the type of adhesive used in joining pad layers or attaching a window to the pad has to be selected on the basis of what type of polishing system will be used. Furthermore, the bonding of the pad layers or windows to the polishing pad is sometimes imperfect or degrades over time. This can result in delamination and buckling of the pad layers and/or leakage of the polishing composition between the pad and the window. In some instances, the window can become dislodged from the polishing pad over time. Methods for forming integrally molded polishing pad windows can be successful in avoiding at least some of these problems, but such methods are often costly and are limited in the type of pad materials that can be used and the type of pad construction that can be produced.

Thus, there remains a need for effective multi-layer polishing pads and polishing pads comprising translucent regions (e.g., windows) that can be produced using efficient and inexpensive methods without relying on the use of an adhesive. The invention provides such polishing pads, as well as methods of their use. These and other advantages of the present invention, as well as additional inventive features, will be apparent from the description of the invention provided herein.

BRIEF SUMMARY OF THE INVENTION

The invention provides a multi-layer polishing pad for use in chemical-mechanical polishing. The polishing pad comprises a polishing layer and a bottom layer, wherein the polishing layer and bottom layer are substantially coextensive and are joined together without the use of an adhesive. The invention also provides a polishing pad comprising a multi-layer optically transmissive region comprising two or more layers that are substantially coextensive and are joined together without the use of an adhesive.

The invention further provides a chemical-mechanical polishing apparatus and method of polishing a workpiece. The CMP apparatus comprises (a) a platen that rotates, (b) a polishing pad of the invention, and (c) a carrier that holds a workpiece to be polished by contacting the rotating polishing pad. The method of polishing comprises the steps of (i) providing a polishing pad of the invention, (ii) contacting a workpiece with the polishing pad, and (iii) moving the polishing pad relative to the workpiece to abrade the workpiece and thereby polish the workpiece.

The invention further provides methods for producing a polishing pad of the invention. A first method comprises (i) placing a polymer sheet under elevated pressure in the presence of a supercritical gas for a predetermined period of time, (ii) allowing the polymer sheet to partially desorb the supercritical gas, and (iii) foaming the partially desorbed polymer sheet by subjecting the sheet to a temperature above the glass transition temperature of the polymer sheet. A second method comprises (i) placing a polymer sheet having a first face and a second face under elevated pressure in the presence of a supercritical gas for a predetermined period of time, (ii) subjecting the first face of the polymer sheet to a first temperature that is above the glass transition temperature of the polymer sheet, (iii) subjecting the second face of the polymer sheet to a second temperature that is below the first temperature, and (iv) foaming the polymer sheet.

DETAILED DESCRIPTION OF THE INVENTION

Figure 1:
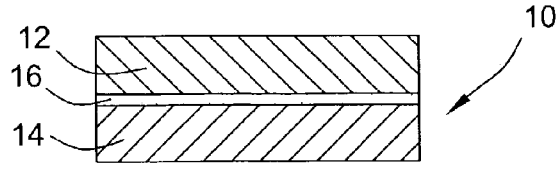
FIG. 1 (PRIOR ART)
FIG. 1 depicts a cross-sectional side view of a prior art multi-layer polishing pad comprising a polishing layer and a bottom layer that are joined together with an adhesive layer.

The invention is directed to a polishing pad comprising a multi-layer polishing pad material, wherein the polishing pad material comprises two or more layers that are joined together without the use of an adhesive. Optionally, the polishing pad material comprises three or more (e.g., four or more, six or more layers, or even eight or more) layers that are joined together without an adhesive. In a first embodiment, the multi-layer polishing pad material is used as a multi-layer polishing pad. In a second embodiment, the multi-layer polishing pad material is used as an optically transmissive region within a polishing pad.

The layers of the polishing pad material do not contain any adhesive between the layers. Adhesive refers to any of the common adhesive materials known in the art, for example, hot melt adhesives, pressure sensitive adhesives, glues, and the like. Rather, the layers of the polishing pad are joined together by physical overlap, interspersement, and/or intertwinement of the polymer resins between each of the layers. Desirably, the layers are substantially coextensive.

The advantage of such multi-layer polishing pad material is that each of the layers can have different physical or chemical properties. For example, in some applications it may be desirable for each of the layers to have the same polymer composition but have different physical properties such as hardness, density, porosity, compressibility, rigidity, tensile modulus, bulk modulus, rheology, creep, glass transition temperature, melt temperature, viscosity, or transparency. In other applications, it may be desirable for the polishing pad layers to have similar physical properties but different chemical properties (e.g., different chemical compositions). Of course, the polishing pad layers can have different chemical properties as well as different physical properties. Preferably, the layers of the polishing pad material will have at least one different chemical or physical property.

Desirably, each layer of the polishing pad material comprises a polymer resin. The polymer resin can be any suitable polymer resin. Typically, the polymer resin is selected from the group consisting of thermoplastic elastomers, thermoset polymers, polyurethanes (e.g., thermoplastic polyurethanes), polyolefins (e.g., thermoplastic polyolefins), polycarbonates, polyvinylalcohols, nylons, elastomeric rubbers, elastomeric polyethylenes, polytetrafluoroethylenes, polyethyleneterephthalates, polyimides, polyaramides, polyarylenes, polyacrylates, polystyrenes, polymethylmethacrylates, copolymers thereof, and mixtures thereof. Preferably, the polymer resin is thermoplastic polyurethane.

The layers can comprise the same polymer resin or can comprise different polymer resins. For example, one layer can comprise a thermoplastic polyurethane while a second layer may comprise a polymer resin selected from the group consisting of polycarbonates, nylons, polyolefins, polyvinylalcohols, polyacrylates, and mixtures thereof. One preferred polishing pad material comprises a thermoplastic polyurethane layer in combination with a layer comprising a polymer resin selected from cross-linked polyacrylamides or polyvinyl alcohols (e.g., cross-linked or non-cross-linked). Another preferred polishing pad material comprises a polycarbonate layer in combination with a layer comprising a polymer resin selected from cross-linked acrylamides or acrylic acids.

The layers of the polishing pad material can be hydrophilic, hydrophobic, or a combination thereof. The hydrophilicity/hydrophobictiy of a polishing pad layer is determined largely by type of polymer resin used to make the layer. Polymer resins having a critical surface tension of about 34 milliNewtons per meter (mN/m) or greater generally are considered hydrophilic, while polymer resins having a critical surface tension of about 33 nM/m or less are generally considered hydrophobic. The critical surface tension of some common polymer resins are as follows (value shown in parentheses): polytetrafluoroethylene (19), polydimethylsiloxane (24), silicone rubber (24), polybutadiene (31), polyethylene (31), polystyrene (33), polypropylene (34), polyester (39–42), polyacrylamide (35–40), polyvinyl alcohol (37), polymethyl methacrylate (39), polyvinyl chloride (39), polysulfone (41), nylon 6 (42), polyurethane (45), and polycarbonate (45). Typically, at least one layer of the polishing pad material is hydrophilic. Preferably two or more layers are hydrophilic.

The layers of the polishing pad material can have any suitable hardness (e.g., about 30–50 Shore A or about 25–80 Shore D). Similarly, the layers can have any suitable density and/or porosity. For example, the layers can be non-porous (e.g., solid), nearly solid (e.g., having less than about 10% void volume), or porous, and can have a density of about 0.3 g/cm$^3$ or higher (e.g., about 0.5 g/cm$^3$ or higher, or about 0.7 g/cm$^3$ or higher) or even about 0.9 g/cm$^3$ (e.g., about 1.1 g/cm$^3$, or up to about 99% of the theoretical density of the material). For some applications, it may be desirable for one layer of the polishing pad material (e.g., a polishing layer) to be hard, dense, and/or have low porosity while the other layer(s) is soft, highly porous, and/or has low density.

The layers of the polishing pad material can have any suitable transparency (i.e., transmissivity to light). For example, one layer can be substantially transparent, while the other(s) is (are) substantially opaque. Alternatively, all of the layers of the polishing pad material can be optically transmissive. When three or more layers are present, the middle layer can be substantially transparent while the outer layers are substantially opaque. Optical transparency is desirable when the polishing pad is used in conjunction with an optical endpoint detection system. The degree of transparency of the polishing pad layers will depend at least in part on (a) the type of polymer resin selected, (b) the concentration and size of pores, and (c) the concentration and size of any embedded particles. Preferably, the optical transmittance (i.e., the total amount of light transmitted through the pad material) is at least about 10% (e.g., about 20%, or about 30%) at at least one wavelength of light between about 200 nm and about 10,000 nm (e.g., between about 200 nm and about 1000 nm).

When the multi-layer polishing pad material is optically transmissive, the material may optionally further comprise a dye, which enables the polishing pad material to selectively transmit light of a particular wavelength(s). The dye acts to filter out undesired wavelengths of light (e.g., background light) and thus improve the signal to noise ratio of detection. The transparent window can comprise any suitable dye or may comprise a combination of dyes. Suitable dyes include polymethine dyes, di-and tri-arylmethine dyes, aza analogues of diarylmethine dyes, aza (18) annulene dyes, natural dyes, nitro dyes, nitroso dyes, azo dyes, anthraquinone dyes, sulfur dyes, and the like. Desirably, the transmission spectrum of the dye matches or overlaps with the wavelength of light used for in situ endpoint detection. For example, when the light source for the endpoint detection (EPD) system is a HeNe laser, which produces visible light having a wavelength of about 633 nm, the dye preferably is a red dye, which is capable of transmitting light having a wavelength of about 633 nm.

The layers of the polishing pad material can have any suitable thickness. Preferably, each layer has a thickness that is at least about 10% or more (e.g., about 20% or more, or about 30% or more) of the total thickness of the multi-layer polishing pad material. The thickness of each layer will depend in part on the total number of polishing pad material layers. Moreover, each of the polishing pad material layers can have the same thickness, or the layers can each have a different thickness.

Figure 2:
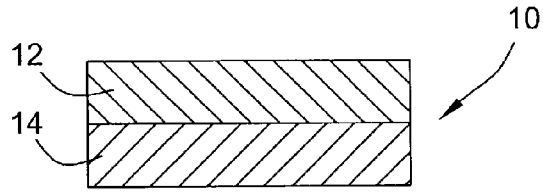
FIG. 2 depicts a cross-sectional side view of a multi-layer polishing pad of the invention comprising a polishing layer and a bottom layer that are joined together without the use of an adhesive.

In the first embodiment, the multi-layer polishing pad material is used as a multi-layer polishing pad. A typical prior art multi-layer polishing pad (10) is depicted in FIG. 1, where a polishing layer (12) is adhered to a bottom layer (14) by way of an adhesive (16) therebetween. Contrastingly, the multi-layer polishing pad of the first embodiment comprises a first layer (e.g., a polishing layer) and a second layer (e.g., a bottom layer) that joined together without an adhesive, as depicted in, for example, FIGS. 2–6. In particular, FIG. 2 depicts a polishing pad (10) comprising a polishing layer (12) and a bottom layer (14). The polishing layer and the bottom layer can comprise the same polymer resin (e.g., polyurethane) or different polymer resins (e.g., polyurethane and polycarbonate). Desirably, the polishing layer has a higher compressive modulus than the bottom layer. For example, the polishing layer can be solid or can have very low porosity while the bottom layer is highly porous (e.g., a foamed polymer).

Figure 3:
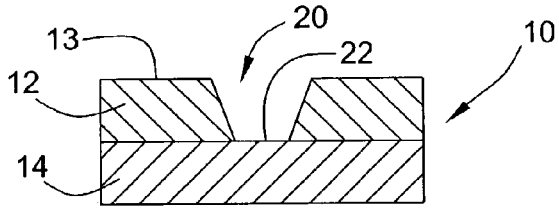
FIG. 3 depicts a cross-sectional side view of a multi-layer polishing pad of the invention comprising a polishing layer and a bottom layer, wherein the bottom layer is optically transmissive and a portion of the polishing layer has been removed so as to reveal an optical detection port.

When the multi-layer polishing pad of the first embodiment is used in conjunction with an in situ endpoint detection system, it may be desirable for at least one layer of the multi-layer polishing pad to have a transmittance to light (e.g., laser light) of about 10% or more (e.g., about 20% or more, or about 30% or more) at at least one wavelength between about 200 nm and about 10,000 nm (e.g., about 200 nm to about 1,000 nm, or about 200 nm to about 800 nm). In some cases, both the polishing layer and bottom layer may be optically transmissive such that the entire polishing pad is at least partially transparent to light. In other cases, only one of the polishing layer and bottom layer may be substantially opaque while the other layer is optically transmissive. For example, the polishing layer can be substantially opaque and the bottom layer can be optically transmissive. In order to use such a polishing pad with an in situ endpoint detection system, a portion of the polishing layer is removed to produce an aperture (20) in the polishing layer (12) which reveals a region (22) of the substantially optically transmissive bottom layer (14), as is depicted in FIG. 3. The optically transmissive region (22) of the bottom layer (14) revealed by the aperture in the polishing layer is thus recessed from the polishing surface (13) so as to protect the "window" from becoming scratched by the polishing composition during a polishing process. In the case of an optically transmissive polishing layer and a substantially opaque bottom layer, a portion of the bottom layer is removed to produce an aperture in the bottom layer, which reveals a region of the substantially optically transmissive polishing layer.

Figure 4:
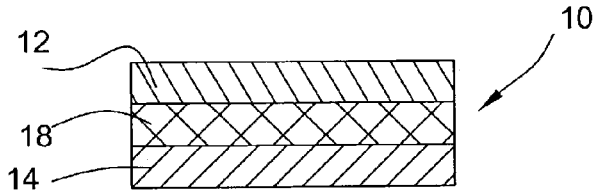
FIG. 4 depicts a cross-sectional side view of a multi-layer polishing pad of the invention comprising a polishing layer, a middle layer, and a bottom layer that are joined together without the use of an adhesive.

The multi-layer polishing pad of the invention also can be a polishing pad as described above, further comprising one or more middle layers disposed between the polishing layer and the bottom layer. Such a polishing pad (10) is depicted in FIG. 4 comprising a polishing layer (12), bottom layer (14), and a middle layer (18). The layers of the polishing pad can have any suitable chemical and physical properties (which can be the same or different as between the layers) as described above. For some applications, it may be desirable for each of the layers to have at least one different chemical or physical property. For example, a polishing pad can comprise a polishing layer comprising a microporous polyurethane, a middle layer comprising a solid polyurethane, and a bottom layer comprising a soft porous polyurethane. Alternatively, the polishing layer can comprise a hydrophilic polymer while the middle layer and bottom layer comprise a hydrophobic polymer and a hydrophilic polymer, respectively.

Figure 5:
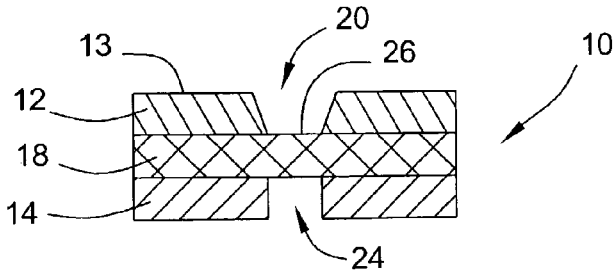
FIG. 5 depicts a cross-sectional side view of a multi-layer polishing pad of the invention comprising a polishing layer, a middle layer, and a bottom layer, wherein the middle layer is optically transmissive and portions of the polishing layer and bottom layer have been removed so as to reveal an optical detection port.

In other applications, it may be desirable for the polishing layer and bottom layer to have the same chemical and physical properties, while the middle layer has at least one different property. For example, the middle layer can have a low compressibility while the polishing layer and bottom layer have a higher compressibility. Alternatively, the middle layer can be substantially transparent while the polishing layer and bottom layer are substantially opaque. Such a polishing pad (10) can be used with an in situ endpoint detection system by removing a portion of the polishing layer (12) and a portion of the bottom layer (14), to produce an aperture (20) in the polishing layer (12) and an aperture (24) in the bottom layer. When the aperture (20) and aperture (24) are aligned (i.e., disposed on top of each other), a region (26) of the substantially optically transmissive middle layer (18) is revealed, as is depicted in FIG. 5. In such a polishing pad, the optically transmissive region (26) of the middle layer (18) revealed by the aperture in the polishing layer and bottom layer is recessed from the polishing surface (13) so as to protect the "window" from becoming scratched by the polishing composition during a polishing process.

The multi-layer polishing pad of the first embodiment can have any suitable dimensions. Typically, the multi-layer polishing pad will have a thickness of about 500 $\mu$m or more (e.g., 750 $\mu$m or more, or about 1000 $\mu$m or more). The multi-layer polishing pad desirably is circular in shape (as is used in rotary polishing tools) or is produced as a looped linear belt (as is used in linear polishing tools). The polishing layer of the multi-layer polishing pad optionally further comprises grooves, perforations, channels, or other such patterns, which facilitate the flow of polishing composition across the surface of the polishing pad. The grooves, channels, etc, can be in the shape of concentric circles, spirals, XY crosshatch patterns, or any other suitable pattern.

The multi-layer polishing pad of the first embodiment optionally further comprises one or more optically transmissive windows that are inserted into an aperture cut into the polishing pad (e.g., in at least one of the polishing layer, middle layer, and bottom layer). Desirably, the window, if present, is bonded to the polishing pad by a means other than the use of an adhesive. For example, the window may be attached to the polishing pad by a welding technique, for example, ultrasonic welding.

The multi-layer polishing pad of the first embodiment optionally further comprises any suitable embedded particles, for example, abrasive particles, water-soluble particles, water-absorbent particles (e.g., water-swellable particles), and the like. The abrasive particles can be inorganic particles or organic particles, including metal oxide particles, polymer particles, diamond particles, silicon carbide particles, and the like. The water-soluble particles can be any suitable chemical-mechanical polishing agents such as oxidizers, complexing agents, acids, bases, dispersants, surfactants, and the like. The water-absorbent particles can be suitable water-absorbent polymer particles.

Figure 6:
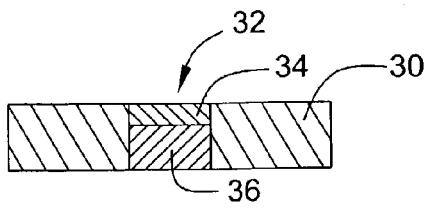
FIG. 6 depicts a cross-sectional side view of a polishing pad comprising a multi-layer optically transmissive window portion, wherein the layers of the window portion are joined together without the use of an adhesive, and the window portion is welded into the polishing pad.

In a second embodiment, the multi-layer polishing pad material is at least partially transparent to the passage of light and is used as an optically transmissive region (e.g., a polishing pad "window") in an otherwise opaque polishing pad. Such a polishing pad is depicted in FIG. 6, wherein the optically transmissive region (32) comprises a first transmissive layer (34) and a second transmissive layer (36), and is affixed into a polishing pad (30). When the optically transmissive polishing pad material is used in conjunction with an endpoint detection system, it is desirable that the polishing pad material have a transmittance to light (e.g., laser light) of about 10% or more (e.g., about 20% or more, or about 30% or more) at at least one wavelength between about 200 nm and about 10,000 nm (e.g., about 200 nm and about 1,000 nm, or about 200 nm and 800 nm). Preferably, the optically transmissive polishing pad material has a light transmittance of about 40% or more (e.g., about 50% or more, or even about 60% or more) at at least one wavelength in the range of about 200 nm to about 35,000 nm (e.g., about 200 nm to about 10,000 nm, or about 200 nm to about 1,000 nm, or even about 200 nm to about 800 nm).

Although each layer of the optically transmissive polishing pad material must have some level of light transmittance, the amount of light that is transmitted by each layer can be different. For example, the first transmissive layer (e.g., polishing layer) of the polishing pad material can be microporous or contain imbedded particles and thus be less transmissive to the passage of light, while the second transmissive layer (e.g., bottom layer) is a non-porous solid sheet that is highly transmissive to the passage of light. Alternatively, both the first and second transmissive layers can be substantially transmissive but have a different polymer composition. Accordingly, the wavelength of light transmitted through the multi-layer polishing pad material can be "tuned" through proper selection of the chemical and physical properties of each layer of the multi-layer polishing pad material. The light transmittance is dependant, in part, on the type of polymer resin used. For example, in a polishing pad material comprising a first transmissive layer (e.g., polishing layer) and a second transmissive layer (e.g., bottom layer), the first layer can comprise a first polymer resin having a transmittance to a certain range of wavelengths of light and the second layer can comprise a second polymer resin having a transmittance to a different but overlapping range of wavelengths of light. According, the overall transmittance of the polishing pad material can be tuned to a narrow wavelength range.

The layers of the optically transmissive polishing pad material of the second embodiment can have any suitable dimensions (i.e., length, width, and thickness) and any suitable shape (e.g., can be round, oval, square, rectangular, triangular, and so on). Typically, the layers have substantially the same length and width (e.g., diameter) such that they are fully coextensive with one another. The optically transmissive polishing pad material can be positioned within a polishing pad so as to be flush (i.e., coplanar) with the polishing surface of the polishing pad or recessed from the polishing surface of the polishing pad. When the optically transmissive polishing pad material is flush with the polishing surface of the polishing pad, the first transmissive layer will constitute a portion of the polishing surface of the polishing pad.

The optically transmissive multi-layer polishing pad material of the second embodiment can have any suitable thickness, and the thickness will vary depending at least in part on the thickness of the polishing pad into which the polishing pad material is placed and the amount of recess that is desired between the top surface of the polishing pad material and the polishing surface of the polishing pad. Typically, the optically transmissive multi-layer polishing pad material will have a total thickness (i.e., from the top surface of the first transmissive layer to the bottom surface of the second transmissive layer) of at least about 10 $\mu$m or more (e.g., about 50 $\mu$m or more, about 100 $\mu$m or more, about 200 $\mu$m or more, or even about 500 $\mu$m or more) when positioned within a polishing pad (e.g., stacked polishing pad) having a thickness of 1000 $\mu$m or more (e.g., about 2000 $\mu$m or more, or even about 3000 $\mu$m or more). Preferably, the optically transmissive multi-layer polishing pad material will have a thickness of about 350 $\mu$m or more (e.g., about 500 $\mu$m or more) for a polishing pad having a thickness of about 1250 $\mu$m or more (e.g., about 1600 $\mu$m or more). The thickness of the layers of the optically transmissive multi-layer polishing pad material can be the same or different. Typically, the first layer of the optically transmissive multi-layer polishing pad material has a thickness that is at least about 10% or more (e.g., about 20% or more, or about 30% or more) of the total thickness of the optically transmissive multi-layer polishing pad material. Similarly, the second layer of the optically transmissive multi-layer polishing pad material typically has a thickness that is at least about 10% or more (e.g., about 20% or more, or about 30% or more) of the total thickness of the optically transmissive multi-layer polishing pad material.

The polishing pad into which an optically transmissive multi-layer polishing pad material of the second embodiment is placed can comprise any suitable polymer resin. For example, the polishing pad typically comprises a polymer resin selected from the group consisting of thermoplastic elastomers, thermoplastic polyurethanes, thermoplastic polyolefins, polycarbonates, polyvinylalcohols, nylons, elastomeric rubbers, elastomeric polyethylenes, copolymers thereof, and mixtures thereof. The polishing pad can be produced by any suitable method including sintering, injection molding, blow molding, extrusion, and the like. The polishing pad can be solid and non-porous, can contain microporous closed cells, can contain open cells, or can contain a fibrous web onto which a polymer has been molded. The polishing pad typically is opaque or only partially translucent.

A polishing pad comprising an optically transmissive multi-layer polishing pad material of the second embodiment has a polishing surface which optionally further comprises grooves, channels, and/or perforations which facilitate the lateral transport of polishing compositions across the surface of the polishing pad. Such grooves, channels, or perforations can be in any suitable pattern and can have any suitable depth and width. The polishing pad can have two or more different groove patterns, for example a combination of large grooves and small grooves as described in U.S. Pat. No. 5,489,233. The grooves can be in the form of slanted grooves, concentric grooves, spiral or circular grooves, XY crosshatch pattern, and can be continuous or non-continuous in connectivity. Preferably, the polishing pad comprises at least small grooves produced by standard pad conditioning methods.

A polishing pad comprising an optically transmissive multi-layer polishing pad material of the second embodiment can comprise, in addition to the optically transmissive multi-layer polishing pad material, one or more other features or components. For example, the polishing pad optionally can comprise regions of differing density, hardness, porosity, and chemical compositions. The polishing pad optionally can comprise solid particles including abrasive particles (e.g., metal oxide particles), polymer particles, water-soluble particles, water-absorbent particles, hollow particles, and the like.

The polishing pads of the invention are particularly suited for use in conjunction with a chemical-mechanical polishing (CMP) apparatus. Typically, the apparatus comprises a platen, which, when in use, is in motion and has a velocity that results from orbital, linear, or circular motion, a polishing pad of the invention in contact with the platen and moving with the platen when in motion, and a carrier that holds a workpiece to be polished by contacting and moving relative to the surface of the polishing pad. The polishing of the workpiece takes place by the workpiece being placed in contact with the polishing pad and then the polishing pad moving relative to the workpiece, typically with a polishing composition therebetween, so as to abrade at least a portion of the workpiece to polish the workpiece. The polishing composition typically comprises a liquid carrier (e.g., an aqueous carrier), a pH adjustor, and optionally an abrasive. Depending on the type of workpiece being polished, the polishing composition optionally may further comprise oxidizing agents, organic acids, complexing agents, pH buffers, surfactants, corrosion inhibitors, anti-foaming agents, and the like. The CMP apparatus can be any suitable CMP apparatus, many of which are known in the art. The polishing pad of the invention also can be used with linear polishing tools.

Desirably, the CMP apparatus further comprises an in situ polishing endpoint detection system, many of which are known in the art. Techniques for inspecting and monitoring the polishing process by analyzing light or other radiation reflected from a surface of the workpiece are known in the art. Such methods are described, for example, in U.S. Pat. Nos. 5,196,353, 5,433,651, 5,609,511, 5,643,046, 5,658,183, 5,730,642, 5,838,447, 5,893,796, 5,949,927, and 5,964,643. Desirably, the inspection or monitoring of the progress of the polishing process with respect to a workpiece being polished enables the determination of the polishing endpoint, i.e., the determination of when to terminate the polishing process with respect to a particular workpiece.

The polishing pads comprising the multi-layer polishing pad material of the invention are suitable for use in polishing many types of workpieces (e.g., substrates or wafers) and workpiece materials. For example, the polishing pads can be used to polish workpieces including memory storage devices, semiconductor substrates, and glass substrates. Suitable workpieces for polishing with the polishing pads include memory or rigid disks, magnetic heads, MEMS devices, semiconductor wafers, field emission displays, and other microelectronic substrates, especially microelectronic substrates comprising insulating layers (e.g., silicon dioxide, silicon nitride, or low dielectric materials) and/or metal-containing layers (e.g., copper, tantalum, tungsten, aluminum, nickel, titanium, platinum, ruthenium, rhodium, iridium or other noble metals).

The multi-layer polishing pad material of the invention can be prepared by any suitable method. One suitable method involves joining together the layers of the polishing pad material by contacting the coextensive faces of the layers while at least one of the layers is at least partially molten. For example, the bonds between the polishing pad layers can be produced by welding (e.g., ultrasonic welding), thermal bonding, radiation-activated bonding, lamination, or coextrusion. A preferred method is coextrusion. Extrusion involves forming a polymer sheet or film by forcing polymer pellets through a shaped die, typically under elevated temperature and/or pressure. In coextrusion, two or more layers of polymer resin are formed as coextensive multi-layer polymer sheets through the use of two or more extruder dies. Multi-layer polymer sheets formed by coextrusion can have any suitable number of layers depending upon the desired application.

Another suitable method involves subjecting one or both faces of a single-layer polymer sheet (e.g., a single-layer polishing pad) to a process that alters the physical properties of one or both faces of the single-layer polymer sheet. For example, a solid polymer sheet can be selectively foamed such that porosity is introduced into one face of the polymer sheet, resulting in a two-layer polymer sheet (e.g., two-layer polishing pad) having a porous layer that is attached to a solid layer without the use of an adhesive. A solid polymer sheet also can be selectively foamed on both faces so as to produce a three-layer polymer sheet (e.g., a three-layer polishing pad) having a solid middle layer and a porous top and bottom layer.

One suitable method of producing a multi-layer polishing pad material comprises the steps of (i) placing a polymer sheet under elevated pressure in the presence of a supercritical gas for a predetermined period of time and (ii) foaming the polymer sheet by subjecting the sheet to a temperature above the glass transition temperature ($T_g$) of the polymer sheet. The polymer sheet can be a solid polymer sheet or a porous polymer sheet. The pressure in step (i) can be any suitable pressure and will depend on the type of polymer sheet and the type of supercritical gas. For example, when the polymer sheet comprises thermoplastic polyurethane, the pressure should be between about 1.5 MPa and about 10 MPa (e.g., between about 2 MPa and about 8 MPa). The supercritical gas can be any suitable gas having sufficient solubility in the polymer (e.g., $N_2$ or $CO_2$) and preferably is $CO_2$. Desirably, the supercritical gas has a solubility of at least about 0.1 mg/g (e.g., about 1 mg/g, or about 10 mg/g). The predetermined amount of time will be determined by the rate of gas absorption into the polymer sheet and the degree of absorption desired. Typically, the amount of time is about 1 hour or more (e.g., about 2 hours or more, or even about 5 hours or more). The foaming temperature can be any suitable temperature. The foaming temperature will depend, at least in part, on the $T_g$ of the polymer sheet. The foaming temperature typically is between the $T_g$ and the melting temperature ($T_m$) of the polymer sheet, although a foaming temperature that is above the $T_m$ of the polymer sheet also can be used.

In one preferred embodiment, the polymer sheet is prevented from uniformly absorbing the supercritical gas. For example, the supercritical gas can be only partially absorbed into the polymer sheet by limiting the absorption time such that only the outer portions of the polymer sheet absorb the supercritical gas. Such a method can further comprise the step of cooling the polymer sheet prior to supercritical gas absorption so as to retard diffusion of the supercritical gas into the polymer sheet. Alternatively, supercritical gas absorption can be limited or prevented along one side of the polymer sheet by applying a supercritical gas barrier material, such as a thin film, foil, thick substrate, or other suitable material, which can prevent or limit absorption of the supercritical gas into the polymer sheet. In some embodiments, the barrier material is a polymer sheet. The portion of the polymer sheet that has absorbed more supercritical gas will have a higher porosity than the remaining portion that has absorbed less or no supercritical gas.

A more preferred method of producing a multi-layer polishing pad material of the invention involves (i) placing a polymer sheet under elevated pressure in the presence of a supercritical gas for a predetermined period of time, (ii) allowing the polymer sheet to partially desorb the supercritical gas, and (iii) foaming the partially desorbed polymer sheet by subjecting the sheet to a temperature above the $T_g$ of the polymer sheet. Steps (i) and (iii) can be carried out under the conditions described above. The portion of the polymer sheet that has desorbed the supercritical gas will have a lower porosity compared to the remaining portion that retained the supercritical gas. In some embodiments, the polymer sheet desirably is saturated with the supercritical gas during step (i). Typically, the polymer sheet typically will be fully saturated in about 60 hours or less (e.g., about 40 hours or less, or about 30 hours or less). The desorption step can be carried out at any suitable temperature and at any suitable pressure. Typically, the desorption step is carried out at room temperature and atmospheric pressure. The rate of gas desorption from the polymer sheet can be controlled by raising the temperature (to increase the desorption rate) or lowering the temperature (to decrease the desorption rate). The amount of time required for the desorption step will depend in the type of polymer as well as the desorption conditions (e.g., temperature and pressure) and will typically be about 5 minutes or more (e.g., about 10 minutes or more).

In another preferred method, the polymer sheet is selectively foamed through control of the temperature applied to the different faces of the polymer sheet. Because the extent of foaming in the polymer sheet is related in part to the temperature, applying different temperatures to either face of a solid polymer sheet can give rise to two different degrees of foaming (e.g., different porosities and/or different pore sizes) within that polymer sheet. Accordingly, the method comprises (i) placing a polymer sheet having a first face and a second face under elevated pressure in the presence of a supercritical gas for a predetermined period of time, (ii) placing the first face of the polymer sheet under a first temperature that is above the $T_g$ of the polymer sheet, (ii) placing a second face of the polymer sheet under a second temperature that is below the first temperature, and (iii) foaming the polymer sheet. The second temperature can be below the $T_g$ of the polymer sheet thereby substantially preventing foaming of that face of the polymer sheet, or the second temperature can be above the $T_g$ of the polymer sheet but below the temperature of the first face of the polymer sheet so that the second face undergoes less foaming than the first face. This method optionally further comprises a desorption step as described above. In one embodiment of this method, the first face of a solid polymer sheet is subjected to rapid thermal annealing and becomes foamed while the second face of the polymer sheet is maintained substantially at room temperature and does not become foamed and remains non-porous.

In a related technique, a multi-layer polymer sheet comprising layers containing different polymer resins having different physical properties (e.g., different $T_g$'s) can be subjected to the same foaming process. In particular, the method comprises the steps of (i) placing the multi-layer polymer sheet under elevated pressure in the presence of a supercritical gas for a predetermined period of time, (ii) subjecting the multi-layer polymer sheet to a temperature that is above the $T_g$ of at least one layer of the polymer sheet, and (iii) foaming the polymer sheet. When the layers of the polishing pad have different thermal properties, the degree of foaming in each layer will be different. Accordingly, each layer of the polishing pad can attain a different porosity despite being foamed using the same foaming conditions. The foaming process and conditions can be any of those discussed above. Similarly, a single-layer porous polishing pad can be treated so as to eliminate or reduce the porosity of one or both faces of the polishing pad, thereby producing a polishing pad comprising a solid layer and a porous layer.

The previous methods generally involve selectively converting a solid polymer sheet to a porous polymer sheet. An alternate approach to producing the multi-layer polishing pad material of the invention involves selectively converting a porous polymer sheet to a non-porous polymer sheet. Specifically, this method involves subjecting one or both faces of a single-layer porous polymer sheet to a temperature above the $T_g$ of the polymer, such that the polymer begins to flow and fill in void spaces. Accordingly, the number of pores on one or both faces of the polymer sheet can be reduced to form a polymer layer having lower porosity or even having no porosity. For example, a porous polymer sheet can be selectively annealed on one face of the polymer sheet, can be passed through a sintering belt that heats one or both faces of the polymer sheet, or can be heated in a mold which selectively cools one or more layers of the polymer sheet. Using these techniques, a variety of multi-layer polishing pads can be produced without the need for an adhesive layer. In particular, two-layer polishing pads comprising a solid layer and a porous layer, as well as, three-layer polishing pads having a solid middle layer and a porous upper and lower layer, or conversely a porous middle layer with a solid upper and lower layer, can be produced.

It is desirable when producing a multi-layer polishing pad material of the invention to minimize the structural boundary between the layers. In coextruded multi-layer polishing pads, there exists a structural boundary between the first layer and second layer that is defined by the region of polymer overlap between the layers. However, other techniques that make use of a single-layer polymer sheet that is selectively modified on one or both faces to have a different physical property, for example the foaming techniques discussed above, do not give rise to such a defined structural boundary. The absence of the structural boundary leads to improved delamination resistance and better polishing consistency.

The following example further illustrates the invention but, of course, should not be construed as in any way limiting its scope.

EXAMPLE

This example illustrates a method of producing a multi-layer polishing pad of the invention comprising a porous layer bound to a non-porous layer without the use of an adhesive.

Figure 7:
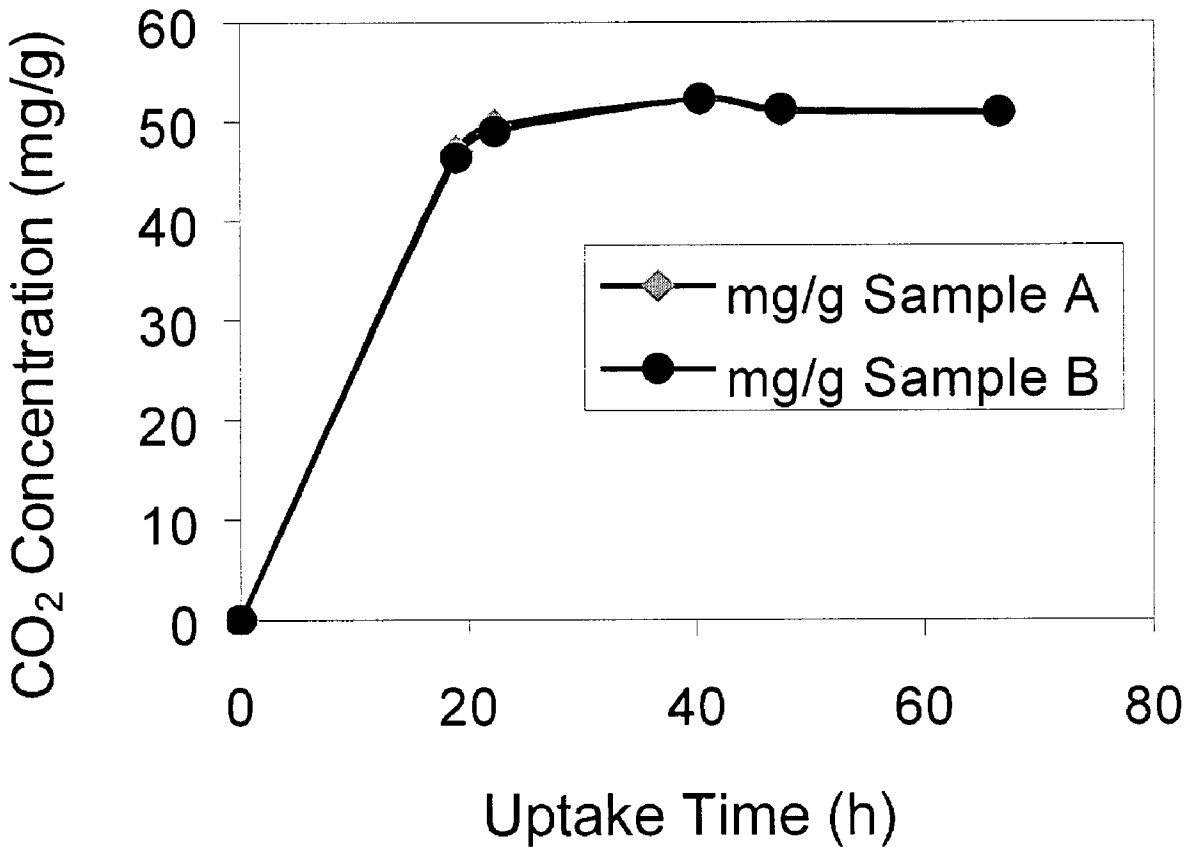
FIG. 7 is a plot of $CO_2$ concentration (mg/g) versus time (hours) for $CO_2$ saturation of a solid polyurethane sheet.
Figure 8:
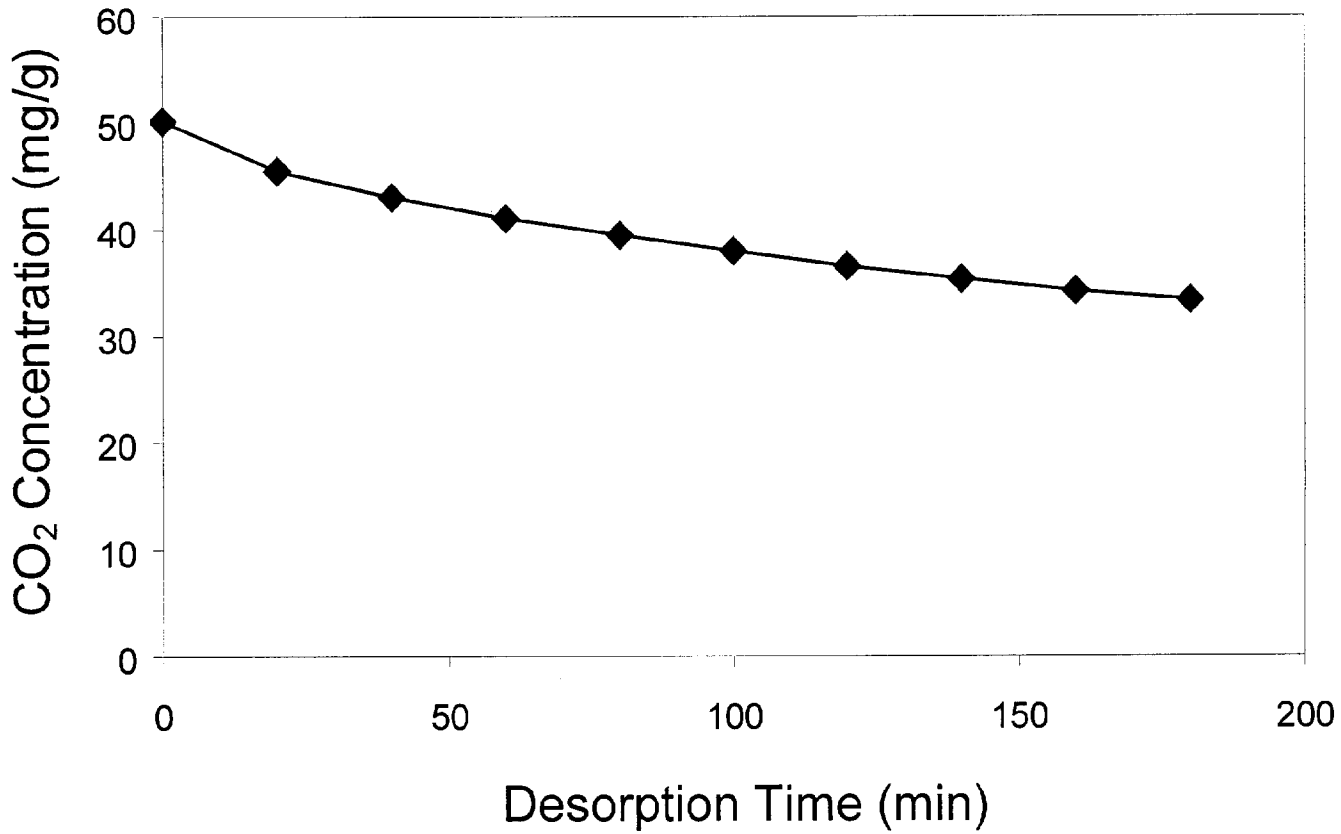
FIG. 8 is a plot of $CO_2$ concentration (mg/g) versus time (min) for $CO_2$ desorption of a solid polyurethane sheet.
Figure 10:
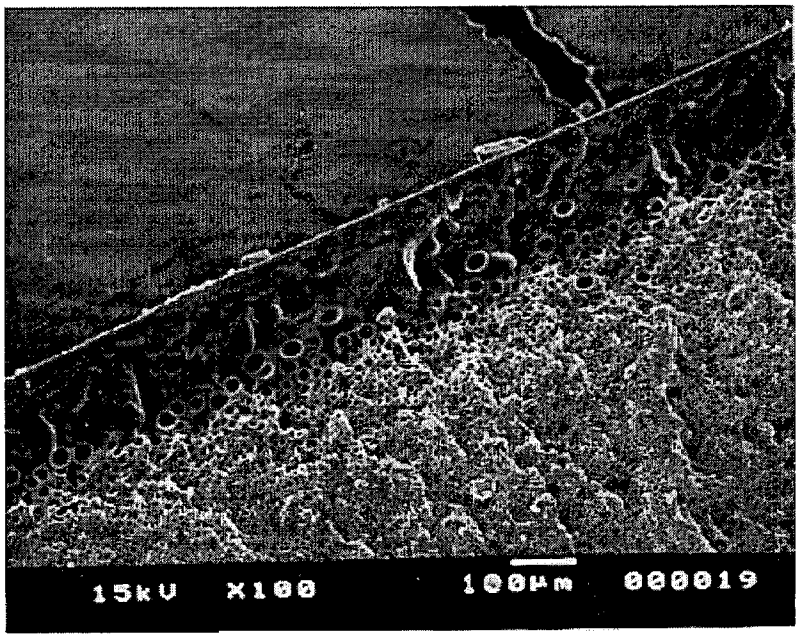
FIG. 10 is a SEM image of a multi-layer polishing pad produced by foaming at 93° C. after 120 minutes of $CO_2$ desorption (Sample B).
Figure 9:
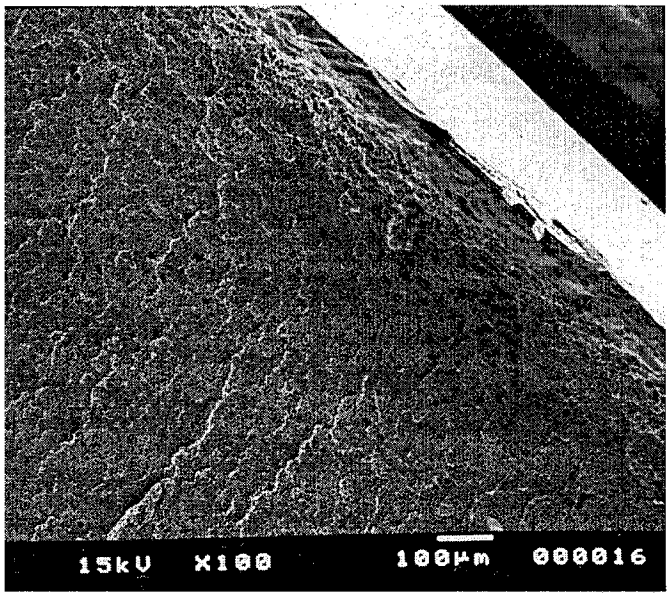
FIG. 9 is a SEM image of a multi-layer polishing pad produced by foaming at 93° C. after 20 minutes of $CO_2$ desorption (Sample A).

Solid thermoplastic polyurethane sheets (Samples A and B) having an average thickness of about 1500 $\mu$m were saturated with $CO_2$ (approximately 50 mg/g thermoplastic polyurethane sample) at room temperature and 5 MPa pressure. A plot of the $CO_2$ uptake as a function of time is shown in FIG. 7. The $CO_2$-saturated samples A and B were then held at room temperature and atmospheric pressure for 20 minutes and 120 minutes, respectively, during which time partial desorption of the $CO_2$ from the polymer sheet occurred. A plot of the $CO_2$ loss as a function of time is shown in FIG. 8. The amount of $CO_2$ loss form the samples was 4.5 mg/g (9%) and 13.5 mg/g (27%) thermoplastic polyurethane sample, respectively. After partial desorption, samples A and B were foamed at 93° C. SEM images of foamed samples A and B are shown in FIGS. 9 and 10, respectively. Sample A has a total average thickness of about 1500 $\mu$m and comprises a 50 $\mu$m solid polishing pad layer and a 1450 $\mu$m porous polishing pad layer. Sample B has a total average thickness of about 1500 $\mu$m and comprises a 200 $\mu$m solid polishing pad layer and a 1300 $\mu$m porous polishing pad layer.

This example demonstrates a method for preparing a multi-layer polishing pad of the invention without requiring the use of an adhesive layer.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A multi-layer polishing pad for chemical-mechanical polishing comprising a polishing layer and a bottom layer, wherein the bottom layer is substantially coextensive with the polishing layer, wherein the polishing layer and the bottom layer are joined together without the use of an adhesive, and wherein (i) the polishing layer is porous and the bottom layer is non-porous or (ii) the polishing layer is non-porous and the bottom layer is porous.

2. The polishing pad of claim 1 wherein the polishing layer comprises a first polymer resin and the bottom layer comprises a second polymer resin.

3. The polishing pad of claim 2, wherein the polishing layer comprises a thermoplastic polyurethane and the bottom layer comprises a polymer resin selected from the group consisting of polycarbonates, nylons, polyolefins, polyvinylalcohols, polyacrylates, polytetrafluoroethylene, polyethyleneterephthalate, polyimides, polyaramides, polyarylenes, polyacrylates, polystyrenes, polymethylmethacrylates, copolymers thereof, and mixtures thereof.

4. The polishing pad of claim 1, wherein the polishing layer is substantially transparent.

5. The polishing pad of claim 4, wherein the polishing layer comprises an aperture.

6. The polishing pad of claim 1, wherein the bottom layer is substantially transparent.

7. The polishing pad of claim 6, wherein the polishing layer comprises an aperture.

8. The polishing pad of claim 1, wherein the polishing layer and the bottom layer comprise a polymer resin.

9. The polishing pad of claim 8, wherein the polymer resin is selected from the group consisting of thermoplastic elastomers, thermoset polymers, polyurethanes, polyolefins, polycarbonates, polyvinylalcohols, nylons, elastomeric rubbers, elastomeric polyethylenes, polytetrafluoroethylene, polyethyleneterephthalate, polyimides, polyaramides, polyarylenes, polyacrylates, polystyrenes, polymethylmethacrylates, copolymers thereof, and mixtures thereof.

10. The polishing pad of claim 9, wherein the polymer resin is a thermoplastic polyurethane.

11. The polishing pad of claim 1, further comprising one or more middle layers disposed between the polishing layer and the bottom layer, wherein the middle layer or layers are substantially coextensive with the polishing layer and the bottom layer, and wherein the polishing layer, middle layer or layers, and the bottom layer are joined together without the use of any adhesive.

12. The polishing pad of claim 11, wherein at least one of the polishing layer and the bottom layer is optically transmissive.

13. The polishing pad of claim 11, wherein the middle layer is optically transmissive and the polishing layer and bottom layer are substantially opaque.

14. The polishing pad of claim 13, wherein the polishing layer comprises a first aperture and the bottom layer comprises a second aperture, and wherein the first aperture is aligned with the second aperture.

15. The polishing pad of claim 11, wherein the polishing layer, middle layer or layers, and the bottom layer comprise a polymer resin.

16. The polishing pad of claim 15, wherein the polymer resin is selected from the group consisting of thermoplastic elastomers, thermoset polymers, polyurethanes, polyolefins, polycarbonates, polyvinylalcohols, nylons, elastomeric rubbers, elastomeric polyethylenes, polytetrafluoroethylene, polyethyleneterephthalate, polyimides, polyaramides, polyarylenes, polyacrylates, polystyrenes, polymethylmethacrylates, copolymers thereof, and mixtures thereof.

17. The polishing pad of claim 16, wherein the polymer resin is a thermoplastic polyurethane.

18. A chemical-mechanical polishing apparatus comprising:

(a) a platen that rotates, (b) the polishing pad of claim 11 affixed to the rotating platen, and (c) a carrier that holds a workpiece to be polished by contacting the rotating polishing pad.

19. The chemical-mechanical polishing apparatus of claim 18, further comprising an in situ endpoint detection system.

20. A method of polishing a workpiece comprising (i) providing the polishing pad of claim 11, (ii) contacting a workpiece with the polishing pad, and (iii) moving the polishing pad relative to the workpiece to abrade the workpiece and thereby polish the workpiece.

21. The polishing pad of claim 1, wherein the polishing pad does not comprise a middle layer disposed between the polishing layer and the bottom layer.

22. A chemical-mechanical polishing apparatus comprising:

(a) a platen that rotates, (b) the polishing pad of claim 1 affixed to the rotating platen, and (c) a carrier that holds a workpiece to be polished by contacting the rotating polishing pad.

23. The chemical-mechanical polishing apparatus of claim 22, further comprising an in situ endpoint detection system.

24. A method of polishing a workpiece comprising (i) providing the polishing pad of claim 1, (ii) contacting a workpiece with the polishing pad, and (iii) moving the polishing pad relative to the workpiece to abrade the workpiece and thereby polish the workpiece.

25. A multi-layer polishing pad for chemical-mechanical polishing comprising a polishing layer, a bottom layer, and one or more middle layers disposed between the polishing layer and the bottom layer, wherein (i) the polishing layer, the bottom layer, and the middle layer or layers are substantially coextensive, (ii) the polishing layer, middle layer or layers, and the bottom layer are joined together without the use of any adhesive, and (iii) the polishing layer and the bottom layer are porous and the middle layer or layers are non-porous.

26. A polishing pad for chemical-mechanical polishing comprising an optically transmissive multi-layer polishing pad material, wherein (i) the optically transmissive polishing pad material comprises a first transmissive layer and a second transmissive layer that are joined together without the use of an adhesive and (ii) the first transmissive layer is porous and the second transmissive layer is non-porous.

27. The polishing pad of claim 26, wherein the optically transmissive multi-layer polishing pad material is formed by coextrusion.

28. The polishing pad of claim 26, wherein the first transmissive layer and the second transmissive layer comprise a polymer resin.

29. The polishing pad of claim 28, wherein the polymer resin is selected from the group consisting of thermoplastic elastomers, thermoset polymers, polyurethanes, polyolefins, polycarbonates, polyvinylalcohols, nylons, elastomeric rubbers, elastomeric polyethylenes, polytetrafluoroethylene, polyethyleneterephthalate, polyimides, polyaramides, polyarylenes, polyacrylates, polystyrenes, polymethylmethacrylates, copolymers thereof, and mixtures thereof.

30. The polishing pad of claim 29, wherein the polymer resin is a thermoplastic polyurethane.

31. The polishing pad of claim 26, wherein the first transmissive layer comprises a first polymer resin, the second transmissive layer comprises a second polymer resin, and the first and second polymer resins are different.

32. The polishing pad of claim 31, wherein the first transmissive layer comprises a thermoplastic polyurethane and the second transmissive layer comprises a polymer resin selected from the group consisting of polycarbonates, nylons, polyolefins, polyvinylalcohols, polyacrylates, polytetrafluoroethylene, polyethyleneterephthalate, polyimides, polyaramides, polyarylenes, polyacrylates, polystyrenes, polymethylmethacrylates, copolymers thereof, and mixtures thereof.

33. The polishing pad of claim 26, wherein the optically transmissive multi-layer polishing pad material further comprises a third transmissive layer disposed between the first transmissive layer and the second transmissive layer.

34. The polishing pad of claim 26, wherein the optically transmissive multi-layer polishing pad material does not comprise a layer disposed between the first transmissive layer and the second transmissive layer.

35. The polishing pad of claim 26, wherein the optically transmissive multi-layer polishing pad material has a light transmittance of about 10% or more at at least one wavelength in the range of about 200 nm to about 10,000 nm.

36. A chemical-mechanical polishing apparatus comprising:

(a) a platen that rotates, (b) the polishing pad of claim 26, and (c) a carrier that holds a workpiece to be polished by contacting the rotating polishing pad.

37. The chemical-mechanical polishing apparatus of claim 36, further comprising an in situ endpoint detection system.

38. A method of polishing a workpiece comprising (i) providing the polishing pad of claim 26

(ii) contacting a workpiece with the polishing pad, and (iii) moving the polishing pad relative to the workpiece to abrade the workpiece and thereby polish the workpiece.

* * * * *